US008075286B2

(12) United States Patent
Guarnieri

(10) Patent No.: US 8,075,286 B2
(45) Date of Patent: Dec. 13, 2011

(54) COMPRESSOR FOR LIQUID OR GASEOUS FLUIDS

(76) Inventor: Ernesto Guarnieri, Campana (AR)

( * ) Notice: Subject to any disclaimer, the term of this patent is extended or adjusted under 35 U.S.C. 154(b) by 1084 days.

(21) Appl. No.: 11/977,237

(22) Filed: Oct. 24, 2007

(65) Prior Publication Data

US 2008/0112827 A1 May 15, 2008

(30) Foreign Application Priority Data

Oct. 24, 2006 (AR) ..... P060104628

(51) Int. Cl.
*F04B 23/04* (2006.01)

(52) U.S. Cl. ..... 417/521; 417/437; 417/454; 417/534
(58) Field of Classification Search ..... 417/437, 417/454, 521, 534
See application file for complete search history.

(56) References Cited

U.S. PATENT DOCUMENTS 4,115,034 A * 9/1978 Smith ..... 417/231
4,712,592 A * 12/1987 Brown ..... 141/98

* cited by examiner

*Primary Examiner* — Charles Freay
*Assistant Examiner* — Patrick Hamo
(74) *Attorney, Agent, or Firm* — Defillo & Associates, Inc.; Evelyn D. Defillo

(57) ABSTRACT

A double-acting compressor to compress liquid or gaseous fluids includes a cylinder having a piston head that reciprocates between opposite ends of the cylinder; a fluid discharge and suction passages defined in at least one of the opposite ends of the cylinder; a fluid suction and compression chamber connected to each end of the cylinder; fluid suction and fluid discharge valves connected to each one of the opposite ends of the cylinder; and pulling device connected to each end of said piston head. The pulling device extends along the cylinder and project out of the ends of the cylinder. The pulling device includes at least one flexible string having fastening means for the manual operation of the compressor.

14 Claims, 8 Drawing Sheets

COMPRESSOR FOR LIQUID OR GASEOUS FLUIDS

FIELD OF THE INVENTION

The present invention is directed to a compressor which can be used indistinctly to compress liquid or gaseous fluids, and more particularly to a single or double acting compressor defined by a cylinder in which a piston head or plunger is provided that can be manually reciprocated between two opposite ends of the cylinder, wherein on at least one of the longitudinally opposite ends one fluid inlet and one pressurized fluid outlet are defined.

It should be noted that, notwithstanding the fact that, in principle, this compressor was conceived and developed for use as a pump for bicycle tires and the like, providing the end-user with remarkable advantages as compared to conventional tire pumps, when put into practice with structural and dimensional adjustments appropriate to each application, it can be used as a universal compressor, for both home and general industrial applications.

BACKGROUND AND ADVANTAGES OF THE INVENTION

There are no known examples of prior-art compressors, whichever their application and operational capacity, with constructive and functional features providing the remarkable advantages of the compressor of this invention. However, by way of a simple comparative example, mention can be made of a known hydraulic compressor which transforms hydraulic energy into mechanical energy. Such compressor comprises two cylindrical bodies, aligned and connected to each other by their adjacent ends, having a sliding rod disposed therein, which has a compression head mounted on each of its opposite ends. Between each of the two heads and the corresponding opposite ends of the compressor a compressed gas chamber is defined, while a hydraulic fluid compression chamber is defined between the two heads along the adjacent portions of the cylindrical bodies. Reciprocation of the heads is caused by the injection and withdrawal of hydraulic fluid and causes the entry of gas and its subsequent discharge, after it has been compressed in the respective chambers, through respective valves located in both cylindrical bodies. Said heads comprise sealing piston rings spaced apart from each other, which define annular spaces between the cylindrical surface of each head and the matching inner surfaces of the cylindrical bodies. Said annular spaces define matching sealing chambers that prevent the passage of compressed gas into the compression hydraulic fluid chambers, wherein said sealing chambers of the heads comprise orifices communicating them with the corresponding compression hydraulic fluid chambers. Said orifices define inflow and outflow passages for pressurized hydraulic fluid, related to the forward and backward movements of the heads with respect to the gas compression chambers.

As it will be clearly explained below, the compressor of the present invention differs from the hydraulic compressor described above, in the first place, in the way it delivers displacement power to the piston, and also because of its remarkable simplicity of construction as compared to the complexity of the compressor of the prior art. While in the compressor of the prior art the source of driving power is hydraulic fluid which is working to achieve compression during the whole cycle, the operating force in the compressor of the invention is applied by means of flexible pulling strings or rigid rods fixed to a piston head, being the admission and compression chambers respectively defined on each of the sides of the piston head.

From the structural standpoint, the prior art compressor comprises two cylinders attached together, and a central wall therebetween which exerts reaction forces making the hydraulic fluid displace the piston, whereby the effective piston stroke is approximately half the total length of the cylinder. In the compressor of the invention, the effective piston stroke is practically equal to the total length of the cylinder; therefore, for the same cylinder length and diameter, the attainable compression ratio in the compressor of the invention is practically twice as much the ratio in the prior art compressor.

Additionally, it should be noted that the hydraulic compressor of the prior art will always requires a fluid compression pump, while the compressor of the invention, because of its versatility, will only need an external power source to run in high power systems, while in low power systems it can be operated manually with little effort. Contrary to the compressor of the prior art, the compressor of the invention was developed to obtain high yields of compression power with small pulling efforts exerted on a piston head by means of pulling elements fixed thereto. Since pulling efforts are easily achieved from the material and component geometry point of view, the weight and volume of the compressor can be reduced, which is an important advantage when the compressor must be transported in low weight, low power vehicles as is the case of bicycles. Additionally, when applying the pulling efforts to the piston head, preferably by means of flexible strings that project outside the compressor body, the strings can be oriented in many directions, Therefore, no extra space is required to operate the compressor as it should be the case when using, for example, rigid rods. The available space is fully utilized, and a high "available room/compression power" ratio is thus attained. However, as it has already been mentioned, in certain applications (for example in the industry), the use of rigid rods as traction means for the piston head may be appropriate. This is by no means a problem, since in this kind of application the available room is typically ample. Other differences and advantages will become apparent in the description of the compressor of the invention, where reference is made to the figures representing it in accordance with one of its preferred practical embodiments.

SUMMARY OF THE INVENTION

An object of the present invention is a double-acting compressor that can be indistinctly used to compress liquid or gaseous fluids, said compressor being defined by a cylinder into which a reciprocating piston head is provided that can be displaced between two opposite ends of the cylinder, wherein in at least one of those cylinder ends, fluid discharge and suction openings are defined. Respective fluid suction and compression chambers are defined on both sides of the piston head, while respective fluid suction and discharge valves are provided at each of the opposite ends of the cylinder. The piston head is connected to tension members provided along the cylinder and projecting outwards from both opposite ends of the cylinder to cause the longitudinal reciprocating displacement of the piston head between the opposite ends of the cylinder.

It is a further object of the present invention a single-acting compressor that can be indistinctly used to compress liquid or gaseous fluids, such compressor being defined by a cylinder into which a reciprocating piston head or plunger is provided that can be displaced between the opposite ends of the cylinder, wherein a valve head is provided in a first end of the cylinder, said valve head comprising fluid suction and discharge openings, wherein a fluid suction and compression chamber is defined on one side of the piston head or plunger, wherein fluid suction and discharge valves are provided in a first end of the cylinder corresponding to such fluid suction and compression chamber, wherein a head defining an air-tight cover is provided in said first cylinder end, wherein said plunger is connected on one side to traction means projecting out of the cylinder for the manual operation of the compressor, and connected on the other side to elastically-deformable traction means extending between said plunger and a second cylinder end, said cylinder being open to allow for the free displacement of the plunger, said traction means being capable of expanding elastically and allow for the displacement of the plunger to effect the compression and discharge of the fluid, and also capable of contracting to force the return of the plunger, thereby suctioning the fluid into the fluid suction and compression chamber.

According to one of the preferred embodiments of the invention, the compressor, either of the single-acting or double-acting type, can be fixed to one of the members of a bicycle frame, as an integral part of said bicycle frame, in which case the compressor is a tire pump. In another preferred embodiment of the invention, the compressor can be attached below the bicycle seat by the head in the first cylinder end, thereby forming the seat post that is housed into the seat tube. In the latter case the compressor is also a tire pump that forms an integral part of the bicycle. In the second embodiment, the seat tube must comprise an orifice to allow for the passage of the discharge valve nozzle, to which the air hose carrying the air to the bicycle tire should be connected, as well as another opening for the suction of air through the suction valve.

DESCRIPTION OF THE FIGURES

For the sake of clarity and understanding of the object of the invention, it has been represented in its preferred exemplary embodiments, which are illustrated in the following figures.

DETAILED DESCRIPTION OF THE INVENTION

Figure 1:
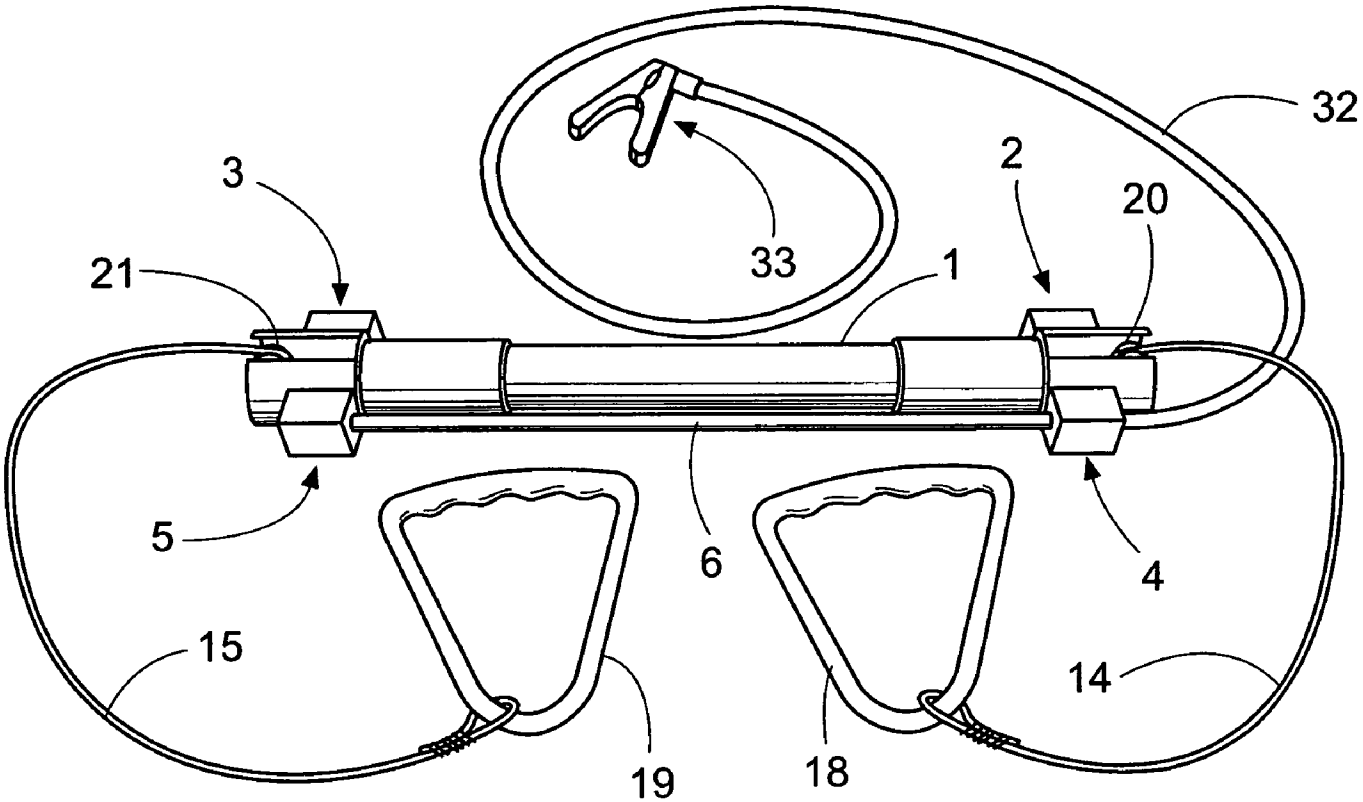
FIG. 1 is a general perspective view of the compressor of the invention according to a first embodiment.
Figure 2:
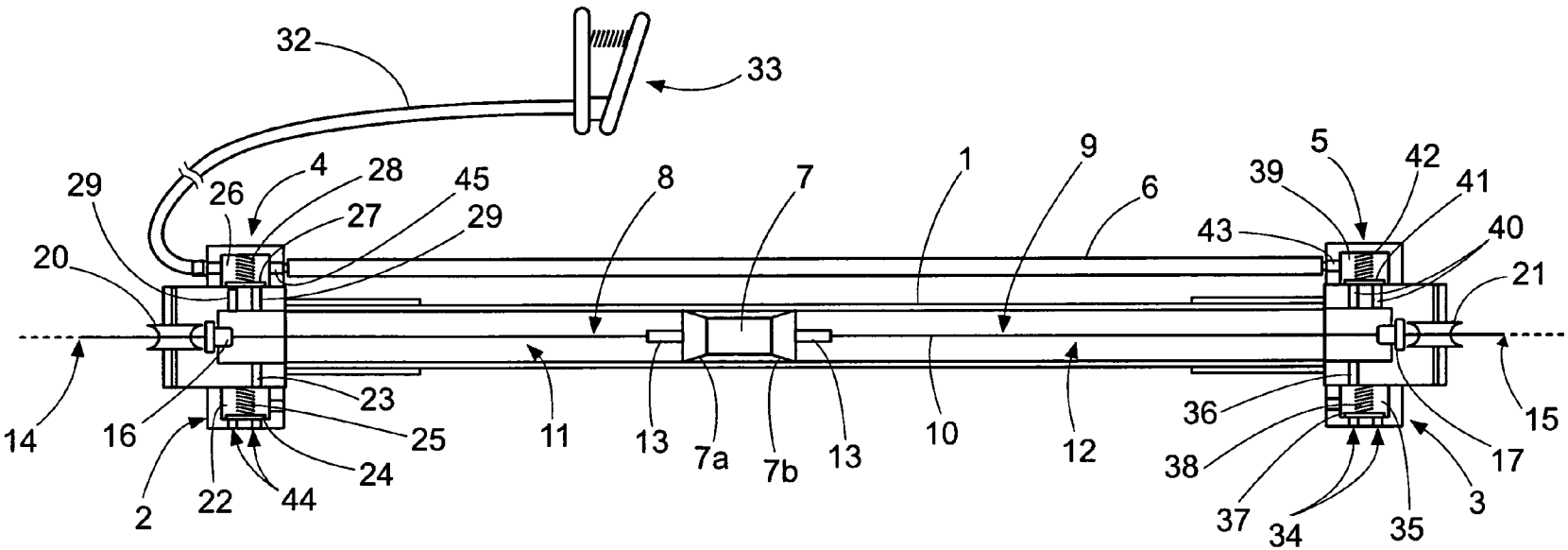
FIG. 2 illustrates schematically a side view in partial longitudinal section of the compressor of FIG. 1.

Starting with the description of FIGS. 1 and 2, it can be appreciated that this double-acting compressor comprises a cylinder 1 which opposite ends have first and second suction valves 2 and 3 respectively for the fluid to be compressed, as well as a first and a second pressurized fluid discharge valves 4 and 5 respectively. The discharge valves 4 and 5 are interconnected by means of a manifold duct 6, through which the compressed fluid to be used during one of the suction-compression cycles is pumped from valve 5 to valve 4. As will be described later, since both suction valves 2 and 3 and discharge valves 4 and 5 are of the check valve type, in each compression cycle one of the suction valves stays open while the other stays closed, and, similarly, while one of the discharge valve stays closed the other stays open.

Within cylinder 1 (see FIG. 2) is provided a piston head 7 that reciprocates between the opposite ends of the cylinder that is between the vicinities of the corresponding suction and discharge valves during the operation of the compressor. On both sides of the piston head 7, corresponding fluid suction and discharge chambers are defined, which mutual tightness is guaranteed by means of annular rings 7*a* y 7*b*. In order to displace the piston head 7 along cylinder 1 alternatively in both directions to effect the suction/compression operations, the piston head is connected to pulling means extending along said cylinder 1 and projecting out of the cylinder from both opposite ends thereof. Said pulling means of piston head 7, depending on the specific application of the compressor, can be define either by a rigid rod or by a flexible string. In the preferred embodiment described herein, said pulling means comprise a flexible string 10 comprising a section 11 placed within the suction/compression chamber 8 and another section 12 placed in the suction/compression chamber 9, as well as sections 14 and 15 projecting out of the cylinder 1. In order to attach firmly piston head 7 to each of the sections 11 and 12 of the flexible string 10 during the operation of the compressor, said string 10 is fastened to each side of piston head 7 by means of corresponding adjusting fasteners 13.

Since in the exemplary embodiment described herein the compressor is operated manually, sections 14 and 15 projecting out of the compressor from the opposite ends thereof, passing through corresponding essentially tubular pieces that define tightness seals 16 and 17 for the suction/compression chambers 8 and 9 of cylinder 1 against the surrounding atmosphere, end in corresponding holding means for the end user, which comprise handles 18 and 19 (see FIG. 1). On each end of the compressor corresponding grooved wheels 20 and 21 are arranged, which define a guide for the outward projection of sections 14 and 15 of string 10, so that the string will slide easily when the end user alternatively pulls from handles 18 and 19 to effect the reciprocating movement of piston head 7 along cylinder 1.

It should be mentioned that when the pulling means of piston head 7 comprise a rigid rod, such rod can also be fitted with handles or, if applicable, a member capable of connecting the rod to a driving mechanism, such as when the compressor is of dimensions and capacity suitable for industrial use. This situation is also valid for the case where the pulling means are flexible strings.

Figure 3:
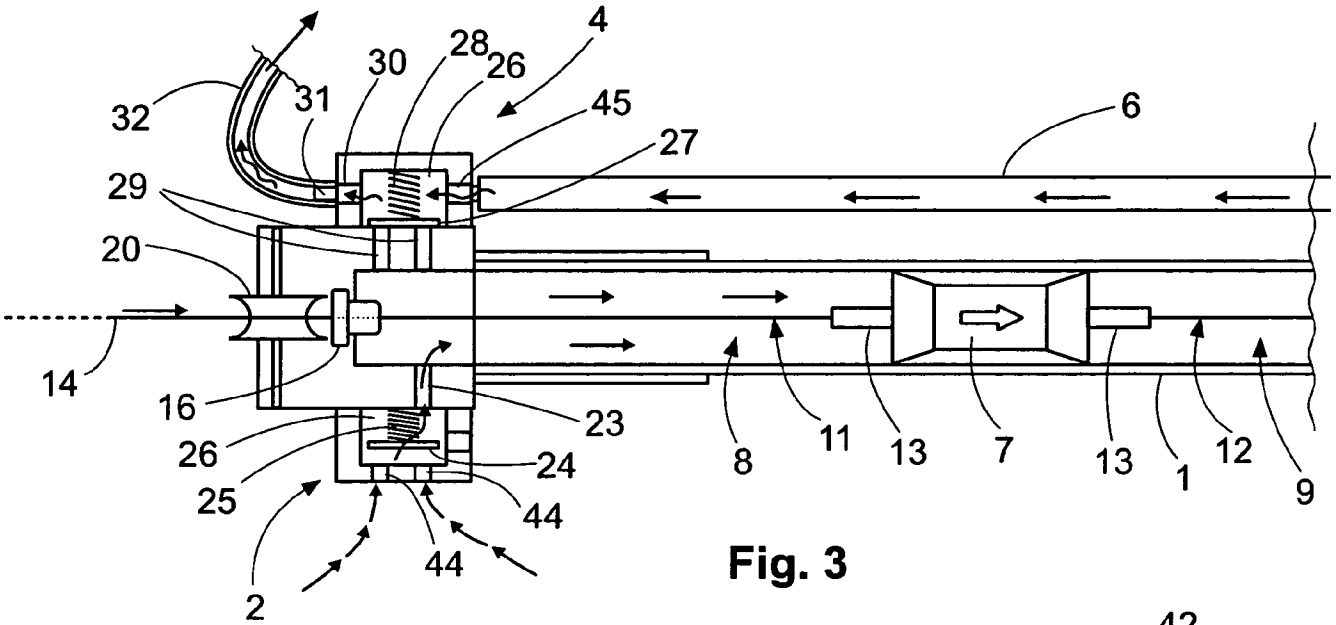
FIGS. 3 to 6 are partial views in longitudinal section of the compressor of FIG. 2, illustrating the operation of the compressor.
Figure 4:
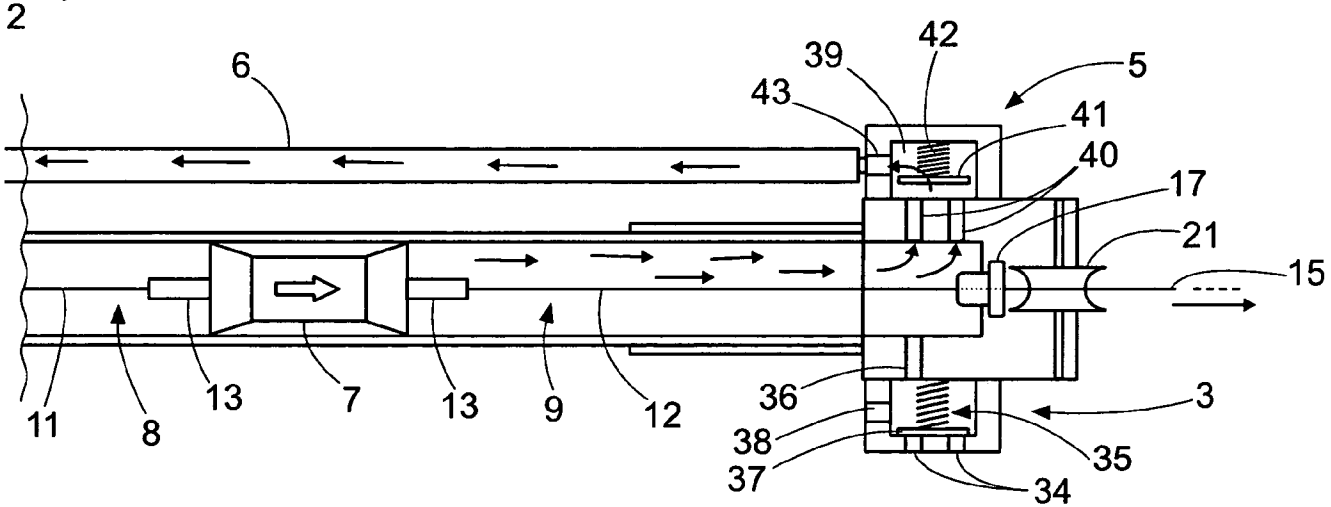

The suction valve 2 comprises openings 44 for the inflow of suction fluid into a chamber 22, and further into the suction/compression chamber 8 through a fluid passage 23. In said chamber 22 a valve mechanism of the "clap" type is arranged, which is defined by a disk 24 and an expansion spring 25. During the suction cycle by means of valve 2 (see FIGS. 3 and 4), the displacement of piston head 7 exerts a suction force enough to overcome the expansion force of spring 25, thereby allowing the suction of fluid through openings 44; the fluid then passes through passage 23 and reaches chamber 8. On the other hand, discharge valve 5 comprises a discharge chamber 39 where a valve mechanism of the "clap" type is arranged, which is defined by a disk 41 and an expansion spring 42. The compression of the fluid exerted by piston head 7 in chamber 9 creates a force strong enough for the fluid to reach openings 40, communicating said chamber 9 with chamber 39 in valve 5, overcomes the expansion force of spring 42 and, consequently, the fluid enters into said chamber 39, passes through passage 43, flows along duct 6, passes through passage 45, and enters into chamber 26 in the discharge valve 4. If openings 29 are closed by disk 27, the fluid is pumped under pressure, through the opening 30, into hose 32, which is connected to the discharge nozzle 31, to inject the pressurized fluid into where the compressor end user needs to. As shown in FIG. 4, during the fluid suction cycle into chamber 8 and compression into chamber 9, the suction valve 3 stays closed under the expansion force of spring 38, with the additional contribution by the pressure of the fluid arriving into chamber 35 through passage 36.

Optionally, in the practice, discharge valve 5 can be made to be identical to discharge valve 4, i.e. comprising a fluid discharge port and a nozzle (not shown), similar to those described with reference numbers 30 and 31, to connect the other hose, such as hose 32. Thus, during the compression cycle in chamber 9 of cylinder 1, pressurized fluid will be made available at the discharge port of both valves 4 and 5, which in turn will allow to, for example, pump compressed fluid simultaneously into the chambers of the two wheels in a bicycle, or wherever it would become necessary according to each particular application of the double-acting compressor of the invention.

A variation of this first embodiment, which is not considered necessary to be illustrated herein, consists in adapting the compressor to work as a "simple-acting" compressor. That is, the compressed fluid will be pumped, for example, only through discharge valve 4, to which hose 32 is connected. To obtain this it is only necessary to remove duct 6 and shut passage 45 of valve 4, and leaving passage 43 of valve 5 open to allow for venting of the fluid, in this case gas or air, reaching said valve 5. Optionally, valves 3 and 5 could be dispensed with, leaving a venting opening where valve 3 and/or 5 used to be.

Additionally, depending of the various possible applications of the compressor of the invention, for example as a pump for bicycle tires and the like, or as a compressor for industrial use, it is possible to take advantage of the concept of "relative motion" between the compressor body and the piston head 7. That is, either keeping the compressor body fixed while displacing the piston head 7 or, conversely, displacing the compressor body while piston head 7 is kept fixed. In order to obtain this in a simple way, sections 14 and 15 of string 10 (or, if applicable, the rigid rod used instead) should be fastened to their corresponding fixing points, and coupling the compressor body, for example, from cylinder 1 or another convenient point, to displacement means of the compressor body. Such displacement means can be the handle used for the manual operation of the compressor, or a suitable driving mechanism with the same purpose.

In another alternative embodiment that can be put into practice, at least one of the sections of the flexible string 10 is hollow and defines a discharge duct for the pressurized fluid, either additional to hose 32 or for individual use. Similarly, hollow rigid rods could be used as traction means for the piston head and also to conduct the pressurized fluid.

In the exemplary embodiment described herein, it is shown that the discharge end of hose 32 is coupled to a tire pump nozzle 33 (see FIG. 1), such as those frequently used to inflate bicycle tires. However, as it will be readily understood, this is just one of the various application examples for the compressor of the invention.

Figure 5:
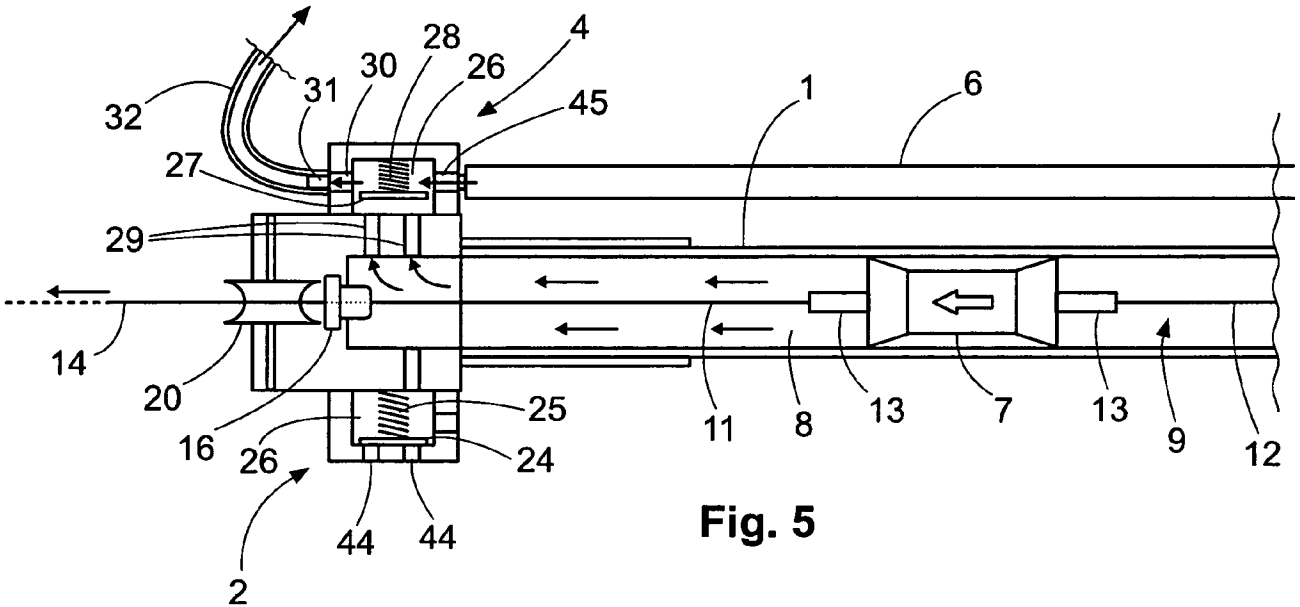
Figure 6:
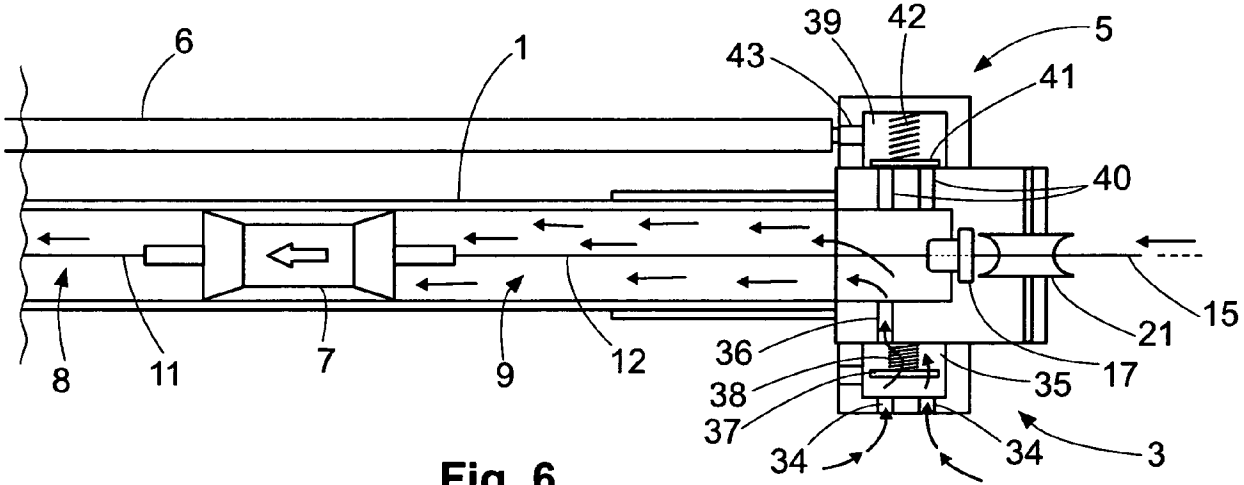
Figure 7:
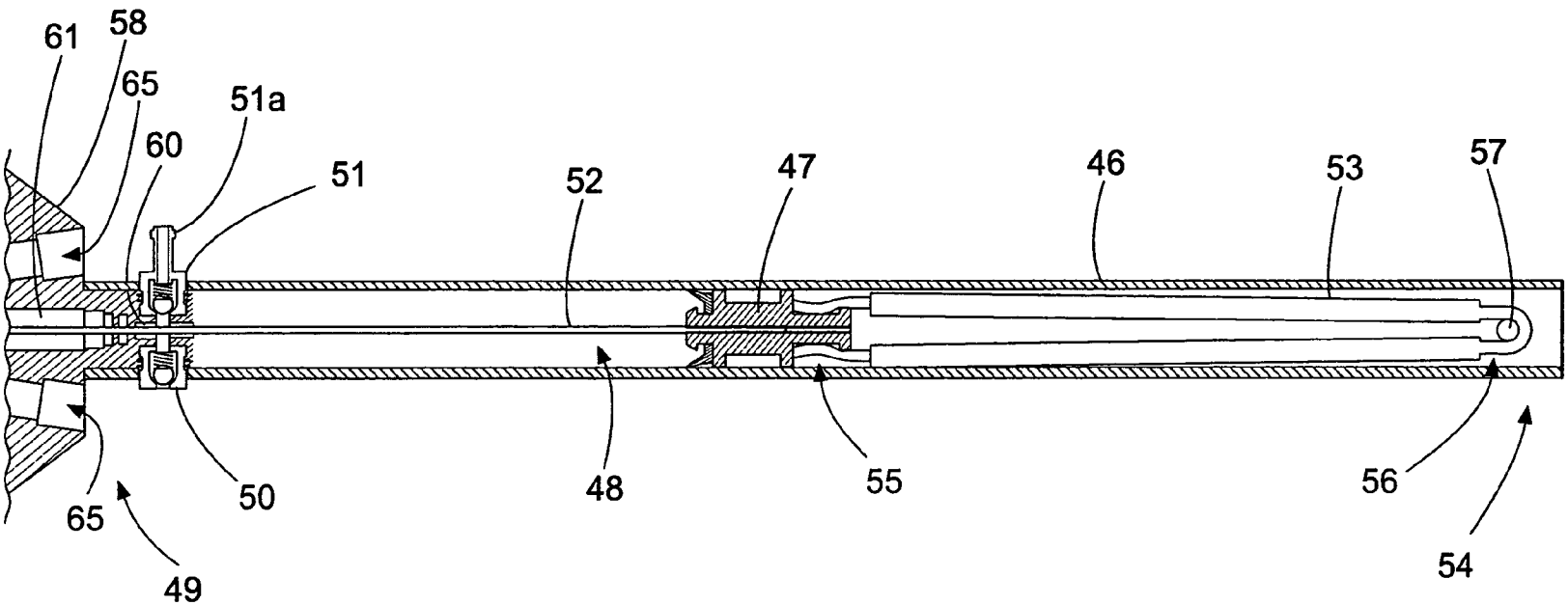
FIG. 7 is a longitudinal section view of a second embodiment of the compressor.
Figure 8:
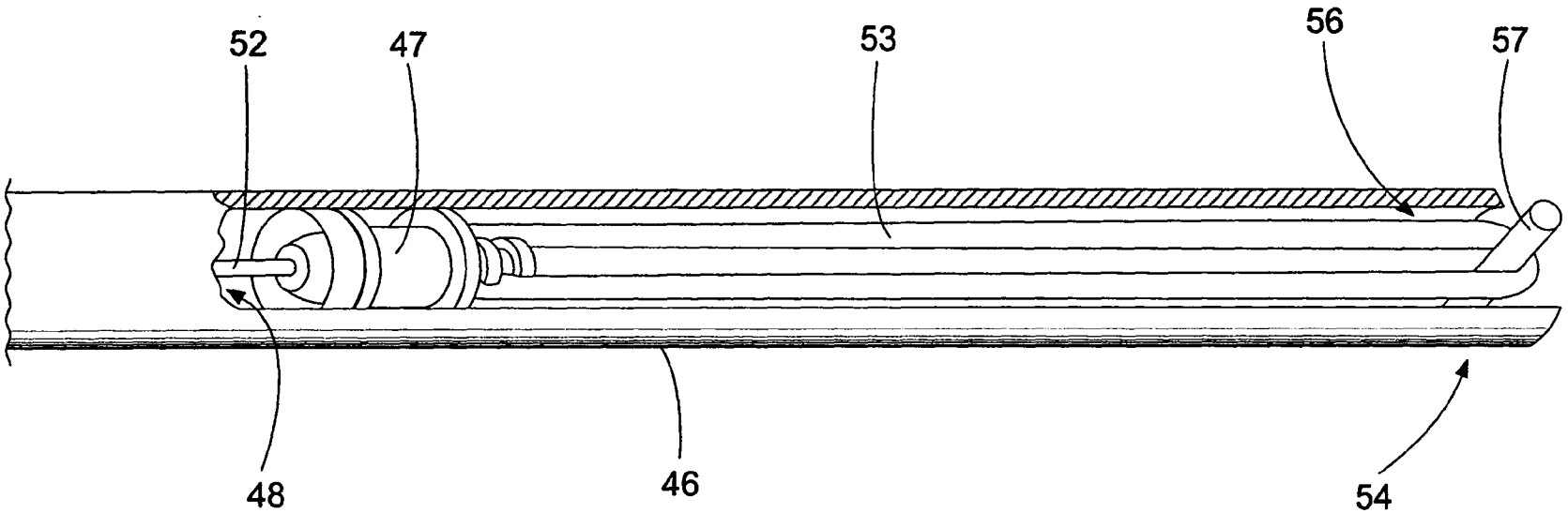
FIG. 8 is a partial perspective and longitudinal section view of the compressor of FIG. 7.

As shown in FIGS. 5 and 6, during the compression cycle of piston head 7 in chamber 8, the operation of suction valves 2 and discharge valves 4 (which has been explained hereinabove), is supplementary, or inverse, with respect to the operation of suction valves 3 and discharge valves 5, which are structurally and operatively linked to the suction/compression chamber 9 of cylinder 1. Suction valve 3, in the same manner as suction valve 2, comprises openings 34 for the suction of fluid into chamber 35, from which the fluid passes to the suction/compression chamber 9 through a fluid passage 36. In said chamber 35 a valve mechanism of the "clap" type is also arranged, which is defined by a disk 37 and an expansion 38. During the suction cycle, the displacement of piston head 7 exerts a suction force strong enough to overcome the expansion force of spring 38, thereby liberating the suction of fluid through openings 34, then flowing through passage 36, and reaching chamber 9 in cylinder 1. The same suction force is added to the expansion force of spring 42, thereby contributing in keeping disk 41 in discharge valve 5 in a shut position regarding openings 40. In this situation, that is, while chamber 9 is in the suction cycle, chamber 8 is operating in the compression cycle and, therefore, the fluid flows through opening 30 of the discharge valve 4, and is pumped under pressure towards hose 32.

Summing up, in this exemplary embodiment, when the end user pulls sections 11 and 12 of string 10 by means of handles 18 and 19 in a reciprocating fashion, he causes the displacement of piston head 7 in one or the other direction along cylinder 1, thus creating alternate fluid suction and compression cycles in chambers 8 and 9. In this way, when the user pulls from section 14 of string 10, piston head 7 creates a suction cycle in chamber 9 and a compression cycle in chamber 8, keeping suction valve 3 open, discharge valve 5 closed, suction valve 2 closed, and discharge valve 4 open. Conversely, when the user pulls from section 15 of string 10, piston head 7 creates a suction cycle in chamber 8 and a compression cycle in chamber 9, keeping suction valve 2 open, discharge valve 4 closed, suction valve 3 closed, and discharge valve 5 open. Consequently, in each fluid suction/compression cycle in chambers 8 and 9, when corresponding, the fluid is always caused to traverse chamber 26 of valve 4 and is forced under pressure towards hose 32.

Figure 11:
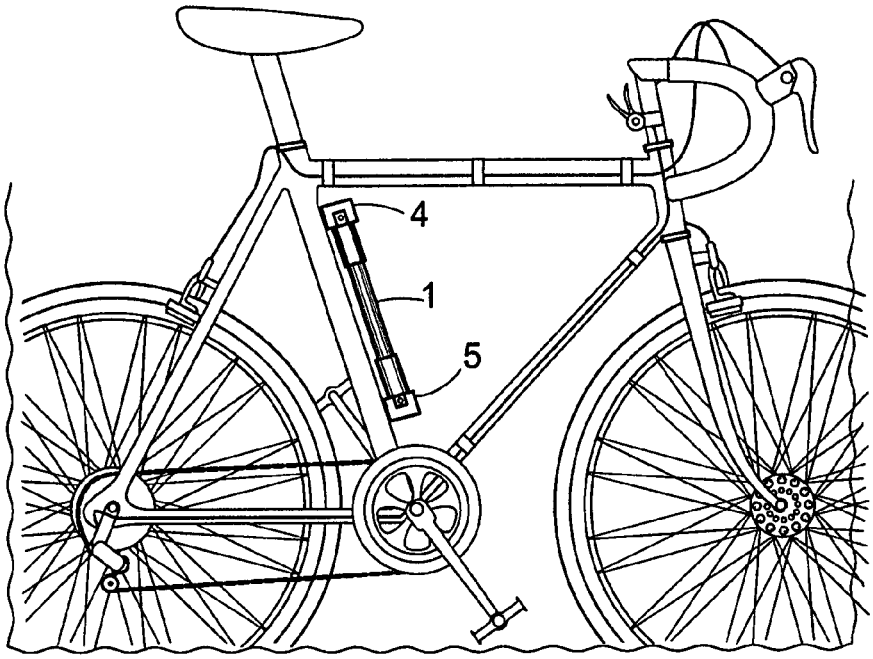
FIG. 11 is a side view of a bicycle with the compressor according to the embodiment of FIG. 1.

A preferred application form of the compressor according with this first embodiment is shown in FIG. 11, where the compressor is shown, which in this example it defines a tire pump, is fastened to a bicycle frame as an integral part thereof. Sections 14 and 15 of string 10 with handles 18 and 19 are not shown here for the sake of simplicity.

In FIGS. 7 to 10 show an additional embodiment of the compressor of the invention, now as a single-acting compressor, comprising a cylinder 46, within which, one side of piston head or plunger 47 defines a chamber 48 of fluid suction and compression, and in a first end 49 of the compressor, adjacent to said chamber 48 of suction and compression, a fluid suction valve 50 and a fluid discharge valve 51 are arranged, comprising a nozzle 51*a* to which a hose is connected, this hose conducts the pressurized fluid to inject it into, for example, a bicycle tire, this application being one of the uses foreseen for the compressor of the invention.

Plunger 47 is connected, on one side, to pulling means defined by a thin flexible string 52 projecting out of cylinder 46 for the manual operation of the compressor, and on the other side to pulling means defined by an elastically deformable string 53 extending between plunger 47 and a second open end 54 of cylinder 46, which allows for the free displacement of plunger 47. In the elastically deformable string 53, which is preferably folded on itself forming two sections, a first end 55 attached to plunger 47, and a second end 56 attached to a string fastening bolt 57 provided in end 54 of cylinder 46. The elastically deformable string 53 is capable of expanding under longitudinal traction and allow plunger 47 to advance so to compress and discharge the fluid, and can also contract, when the pulling force is released, so to force plunger 47 to retreat and allow for the suction of fluid into fluid suction and compression chamber 48.

At end 49 of the cylinder a head 58 is provided that defines a tight cover including housings for fluid suction and discharge valves 50 and 51, and the pulling string 52 projects out of cylinder 46 through a opening in said head 58, terminating in a user-operable end where a traction handle 59 for the manual operation of the compressor is arranged. Head 58 comprises a tubular piece 60 made of elastic material, defining a tight passage for the pulling string 52, and a grooved wheel 61, rotatably mounted on a shaft 62, thus defining a guide for the displacement of said pulling string 52.

Figure 10:
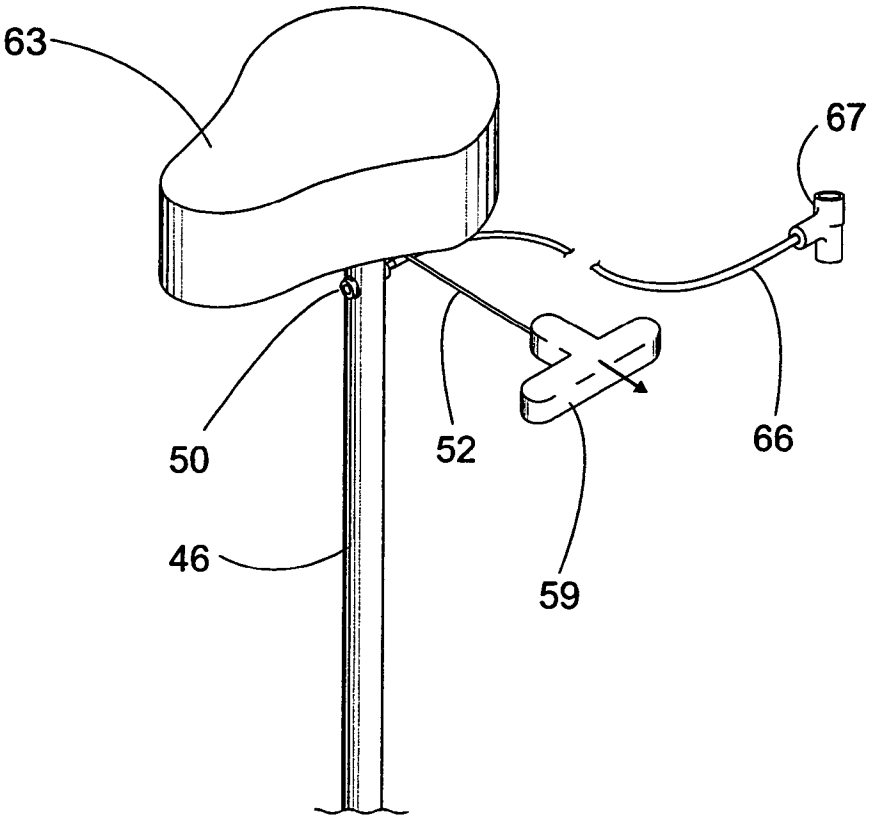
FIG. 10 is a perspective view showing the compressor of FIG. 7 fixed to a bicycle seat.
Figure 9:
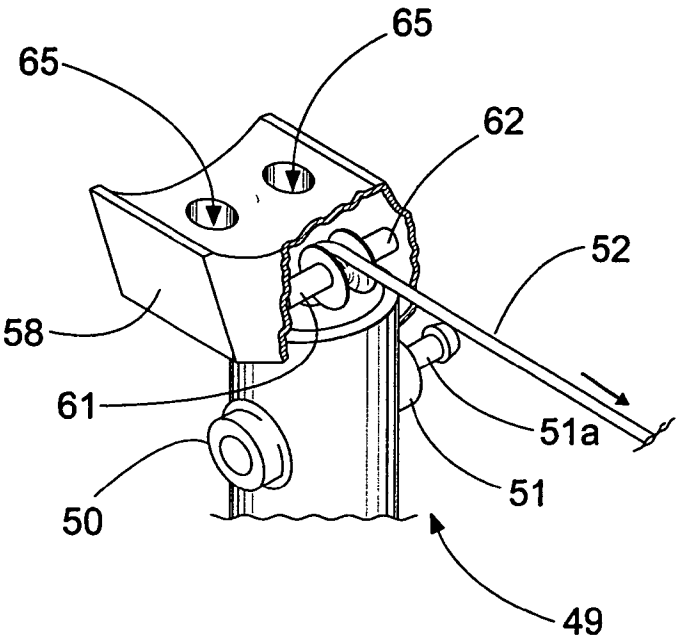
FIG. 9 is a partial perspective view of the upper end of the compressor of FIG. 7, from which it is fixed to a bicycle seat.
Figure 12:
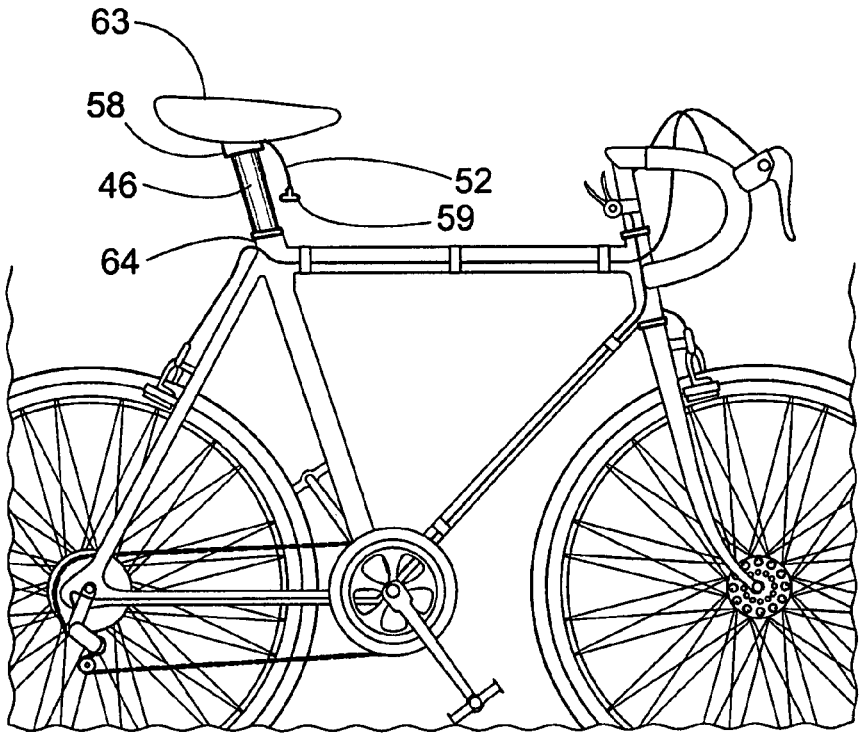
FIG. 12 is a side view of a bicycle with the compressor according to the embodiment of FIG. 7.

FIG. 10 illustrates one of the exemplary uses of the compressor according with this second embodiment, where it is possible to appreciate that cylinder 46 is fixed to seat 63 of a bicycle through head 58 placed at end 49 of cylinder 46 (see FIG. 12), thereby forming the seat post housed inside the seat tube, which serves to attach seat 63 to the bicycle frame. Head 58 comprises a pair of openings 65 for the passage therethrough of screws to attach the compressor to the base of seat 63. In this way, the compressor comprises a tire pump as an integral part of the bicycle frame. The seat tube 64, or an extension thereof, or a part of the bicycle frame connecting with the open end 54 of cylinder 46, should comprise at least one opening connecting with the surrounding atmosphere, to allow for free air suction and discharge, so that plunger 47 can easily move back and forth, that is, without being affected by vacuum or air pressure accumulating in the bicycle frame.

The compression cycle starts by displacing plunger 47 towards the end 49 of cylinder 46, where the head 58 is attached, by means of the pulling force exerted by flexible string 52 from handle 59. When plunger 47 advances, it compresses the fluid in compression chamber 48, suction valve 50 closes, discharge valve 51 opens, and the compressed fluid is discharged through nozzle 51*a*, and runs along 66, with its corresponding fitting 67, which has been connected to said nozzle 51*a* to inject compressed air into the bicycle tire that needs to be inflated. During such displacement of plunger 47, the elastic string 53 stretches and accumulates contraction energy. After the compression cycle is finished, plunger 47 is liberated by stopping to pull from handle 59, then the flexible string 52 becomes loose, and the elastic string 53 contracts until finally reaching its rest state, returning plunger 47 to its initial position. When plunger 47 starts its return movement, it creates vacuum in the compression chamber 48, thereby closing discharge valve 51 and opening suction valve 50, thus allowing the suction of air into the compression chamber 48, and leaving the compressor ready to start a new operation cycle.

What is claimed is:

1. A double-acting compressor that can be used indistinctly to compress liquid or gaseous fluids, said compressor comprising:

a cylinder having a piston head provided therein that reciprocates between opposite ends of said cylinder, fluid discharge and suction passages defined in at least one of the opposite ends of the cylinder, a fluid suction and compression chamber connected to each end of the cylinder, fluid suction and fluid discharge valves connected to each one of the opposite ends of the cylinder, pulling means connected to each end of said piston head, wherein the pulling means extend along the cylinder and project out of the ends of the cylinder wherein said pulling means of the piston head comprise at least one flexible string, wherein each flexible string includes fastening means for the manual operation of the compressor, and wherein at least one of the sections of said flexible string is hollow and defines a discharge duct for the pressurized fluid.

2. The compressor according to claim 1, wherein each discharge valve includes a fluid discharge chamber, wherein the fluid discharge valves are interconnected by a pressurized fluid duct, at least one of said discharge valve comprises a discharge opening for the pressurized fluid.

3. The compressor according to claim 2, wherein said suction and discharge valves are check type valves, wherein in each compression cycle towards one end of the cylinder the discharge valve in said end stays open and the valve in the other end remains closed, while the suction valve in said end stays closed while the valve in the other end remains open.

4. The compressor according to claim 2, wherein at least one of said discharge valves comprises a discharge opening that can be connected to an external compressed fluid duct.

5. The compressor according to claim 1, wherein in each of the ends of the cylinder at least one grooved wheel is provided which defines a guide for the projection of said pulling means out of the cylinder.

6. The compressor according to claim 1, wherein in both ends of the cylinder said pulling means pass through a substantially tubular piece defining a tight seal between the surrounding atmosphere and the inner portion of the corresponding suction and compression chambers of the cylinder.

7. The compressor according to claim 1, wherein the compressor is fixed to a bicycle frame, thereby constituting a tire pump that is an integral part of the bicycle frame.

8. A double-acting compressor that can be used indistinctly to compress liquid or gaseous fluids, said compressor comprising:

a cylinder having a piston head provided therein that reciprocates between opposite ends of said cylinder, fluid discharge and suction passages defined in at least one of the opposite ends of the cylinder, a fluid suction and compression chamber connected to each end of the cylinder, fluid suction and fluid discharge valves connected to each one of the opposite ends of the cylinder, pulling means connected to each end of said piston head wherein the pulling means extend along the cylinder and project out of the ends of the cylinder, wherein said pulling means of the piston head comprise at least one rigid rod, and wherein at least one of the sections of said rigid rod is hollow and defines a discharge duct for the pressurized fluid.

9. The compressor according to claim 8, wherein each rigid rod includes fastening means for the manual operation of the compressor.

10. A single-acting compressor that can be indistinctly used to compress liquid or gaseous fluids, said compressor comprising:

a cylinder having a displaceable piston head or plunger provided therein that reciprocates between opposite ends of the cylinder, a valve head connected to one of the end of the cylinder, the valve head includes fluid suction and discharge passages, a fluid suction and compression chamber connected to on one side of the piston head or plunger, fluid suction and discharge valves connected to said suction and compression chamber, a head connected to the end of the cylinder including the valve head, pulling means connected to one end of said piston head or plunger, wherein the pulling means projects out of the cylinder for the manual operation of the compressor, and elastically deformable pulling means connected to the other side of the cylinder, wherein the elastically deformable pulling means extends between said piston head or plunger and the end of the cylinder, wherein said elastically deformable pulling means elastically expands allowing the advance of the plunger to effect the compression and discharge of the fluid, wherein said elastically deformable pulling means contracts to force the retreat of the plunger and allow the suction of fluid into the fluid suction and compression chamber.

11. The compressor of claim 10, wherein said elastically deformable pulling means comprise at least one elastic string having a first end attached to the plunger and a second end attached to a fastening element in said second end of the cylinder.

12. The compressor of claim 10, wherein said pulling means comprise a thin flexible string passing through an opening in the tightly sealed cover in the first end of the cylinder, said thin flexible string having an end that can be operated from outside the cylinder, where a handle for the manual operation of the compressor is arranged.

13. The compressor of claim 12, wherein the head provided in the first end of the cylinder comprises housings for the fluid suction and compression valves, a tubular piece of elastic material defining a tightly sealed passage for said flexible string, and a grooved wheel defining an external guide for the displacement of the flexible string.

14. The compressor of claim 10, wherein the cylinder is attached to a bicycle seat by the head provided at the first end of the cylinder, thereby forming the seat post housed inside the seat tube, thus constituting the compressor a tire pump that is an integral part of the bicycle frame.

* * * * *